US005152115A

United States Patent [19]

Cotter

[11] Patent Number: 5,152,115

[45] Date of Patent: Oct. 6, 1992

[54] ROOFING/CLADDING SYSTEM

[75] Inventor: Donald P. Cotter, Livermore Falls, Me.

[73] Assignee: Cotterco, Inc., Livermore Falls, Me.

[21] Appl. No.: 667,703

[22] Filed: Mar. 11, 1991

[51] Int. Cl.[5] ..... E04B 7/00

[52] U.S. Cl. ..... 52/466; 52/460; 52/469; 52/463; 52/467

[58] Field of Search ..... 52/460, 461, 463, 465, 52/466, 467, 468, 469, 470

[56] References Cited

U.S. PATENT DOCUMENTS

| | | | |
|---|---|---|---|
| 2,055,127 | 9/1936 | Goodwin | 52/463 |
| 2,408,557 | 10/1946 | Huntington | 52/466 |
| 2,907,287 | 10/1959 | Trostle | 52/463 |
| 2,976,648 | 3/1961 | Linck | 52/467 |
| 3,327,443 | 6/1967 | Gay et al. | 52/460 |
| 3,335,537 | 8/1967 | Mackey | 52/463 |
| 3,376,680 | 4/1968 | Gyekis | 52/463 |
| 3,402,521 | 9/1968 | Tischuk | 52/460 |
| 4,001,995 | 1/1977 | Cotter | 52/460 |
| 4,400,924 | 8/1983 | Andrews | 52/466 |
| 4,497,151 | 2/1985 | Simpson et al. | 52/467 X |
| 4,583,339 | 4/1986 | Cotter | 52/466 |

OTHER PUBLICATIONS

Drawing titled "Doub'l Lock", dated Nov. 10, 1986.

*Primary Examiner*—Richard E. Chilcot, Jr.
*Assistant Examiner*—Robert Canfield
*Attorney, Agent, or Firm*—Graham & James

[57] ABSTRACT

A roofing/cladding system (2) for mounting to a structure (4) includes elongate pans (6) having central portions (32) and lateral edges (8, 10) with U-shaped pockets (24, 26) defining inwardly opening edge recesses (28, 30). The pan also includes legs (34, 36) extending upwardly from the upper part (38, 40) of the pockets. The upper edges (72, 74) of the legs are plain to facilitate bending the pans to cover concave or convex surfaces. A bracket (12), used to hold down the pans at their opposed edges, has a base (14), first, upwardly extending arms (46, 48) and second, downwardly extending arms (50, 52) and defining regions (58, 60) therebetween. The legs of the pans are inserted into the regions. A batten (18), used to cover the joint, has inwardly extending lips (68, 70) which extend into the edge recesses immediately beneath the lower ends of the second arms so that vertical movement of the pans and batten are resisted almost immediately by the engagement of the lower ends of the second legs with the lips of the batten. Also, the upper edges (72, 74) of the legs are positioned at the junctions of the first and second arms to further limit upward movement of the pan.

5 Claims, 2 Drawing Sheets

ROOFING/CLADDING SYSTEM

BACKGROUND OF THE INVENTION

The invention is related to roofing/cladding systems using elongate pans joined at their edges by hold-down clips and battens, the pans being straight or curved to cover flat, convex or concave surfaces.

Batten-style roofing/cladding systems are widely used for covering roofs, walls and similar structures. For simplicity, these systems will be referred to as roofing systems with the understanding that the invention is not so limited.

One of the problems with batten-style roofing systems is the ability to meet current engineering criteria for structural performance under negative loads, most often caused by wind. Negative loads tend to the lift the pans from the structure, thus placing a great deal of stress on the brackets holding the edges of the pans. To reduce costs of roofing systems using elongate pans having formed edges, such as batten-style systems, roll forming machines to produce the roofing components at the job site have been developed. With this technology, one or more roll forming machines are carried by a vehicle which also carries a large roll of material for each machine. This permits the pans and battens to be produced to exact lengths on site thus removing the need for lap joints. It also eliminates the cost of packaging non-nestable profiles as well. Freight damage is also eliminated with this type of system.

Another problem which must be addressed by batten-style roofing systems is thermal expansion and contraction. A roofing panel 150 feet long made from aluminum would expand and contract approximately 2 inches with a 100° F. temperature change. Such expansion and contraction requires that the hold-down brackets permit the pans to slip longitudinally to accommodate this movement.

Other problems are created when roofing systems are used to cover curved structures. With batten-style, as well as standing-seam style, roofing systems, curved panels have generally been created by the use of crimping. The crimping not only is generally thought unsightly, it also degrades the surface integrity of the pans. Pans typically are prepainted or have other prepared surfaces for both aesthetic and corrosion reasons. However, crimping causes small cracks in the prepared surfaces for loss of surface integrity, thus permitting oxidation and discoloration of the panels.

SUMMARY OF THE INVENTION

The present invention is directed to a roofing/cladding system which is simple in construction, inexpensive and yet highly versatile for use in both straight and curved applications.

The roofing/cladding system includes elongate pans having central portions and lateral edges and designed for mounting to a support surface. The edges each have generally U-shaped pockets or receptacles defining edge recesses opening inwardly towards the center of the pan. The upper part of each pocket has an upwardly extending (that is away from the support surface), generally vertical leg. The upper edge of the vertical leg is plain to facilitate forming the pans with a chosen curvature.

Brackets are used to hold down the opposed edges of adjacent pans. The brackets each have a base and upwardly extending hold-down elements. Each hold-down element has a first upwardly extending arm and a second, downwardly extending arm which define a region therebetween. The vertical legs of the pans are inserted into the regions defined by the hold-down elements of the bracket. A batten is used to cover the edge joint and has sides and inwardly extending lips at the lower edges of the sides. The lips extend into the edge recesses formed by the U-shaped pockets.

The brackets are preferably sized so that lower ends of the second legs of the bracket are positioned at the entrance to the edge recesses. In this way, vertical movement of the pans and batten are resisted almost immediately by the hold-down elements of the bracket through the engagement of the lower ends of the second legs with the lips of the batten. Also, the legs of the pan are preferably sized so that the upper edges of the vertical legs of the pan are positioned at the junctions of the first and second arms of the bracket to further limit upward movement of the pan.

One of the primary advantages of the invention is its simplicity. The pan, bracket and batten all have relatively simple cross-sectional profiles making their manufacture relatively inexpensive and straightforward. Another advantage of the invention is the use of a bracket having a variable length. This is very helpful since different portions of a structure require different amounts of hold-down force. For example, at a ridge line a longer bracket, with more fasteners to secure the bracket to the structure, can be used in contrast with shorter brackets used midway along the span.

Another key feature of the invention is that the profile of the pan is such that it can be formed as a curved panel without the need for pocketing or other gross deformation. Therefore, with the present invention the desirable smooth surface and surface integrity of the panels is maintained. Since the panels and battens are separate structures, they can be addressed separately as to the method of curving used. One such method of curving is disclosed in my copending patent application Ser. No. 07/667,729, entitled APPARATUS FOR FORMING ROOFING/CLADDING SYSTEM COMPONENTS, filed on the same date as this application, the disclosure of which is incorporated by reference.

Manufacturers of curved and rolled metal products commonly use a neutral line diameter true lengths in rolling or curving metal. Typically, the true length is approximately halfway between the inside and outside diameter of the curved material. The material to the inside of the neutral diameter is in compression while the material outside of the neutral diameter is in tension. One of the ways applicants' invention eliminates the need for pocketing and other gross deformation of the pan when curved is by designing the cross-sectional shape of the pan such that the neutral diameter is very close to the central portion of the pan. This is achieved by using simple vertical legs terminating in a plain or sheared end. Thus, the main resistance to bending is closer to the central portion of the pan than if the vertical legs of the pan were pocketed or rolled-over. In addition, the vertical legs of the pans are preferably limited to less than about half the height of the batten. The net result is that the vertical leg will sufficiently stretch (for convex curves) or compress (for concave curves) to avoid deformation of the visible portions of the pan.

Other features and advantages of the invention will appear from the following description in which the preferred embodiment has been set forth in detail in conjunction with the accompanying drawings.

DESCRIPTION OF THE PREFERRED EMBODIMENT

Figure 1:
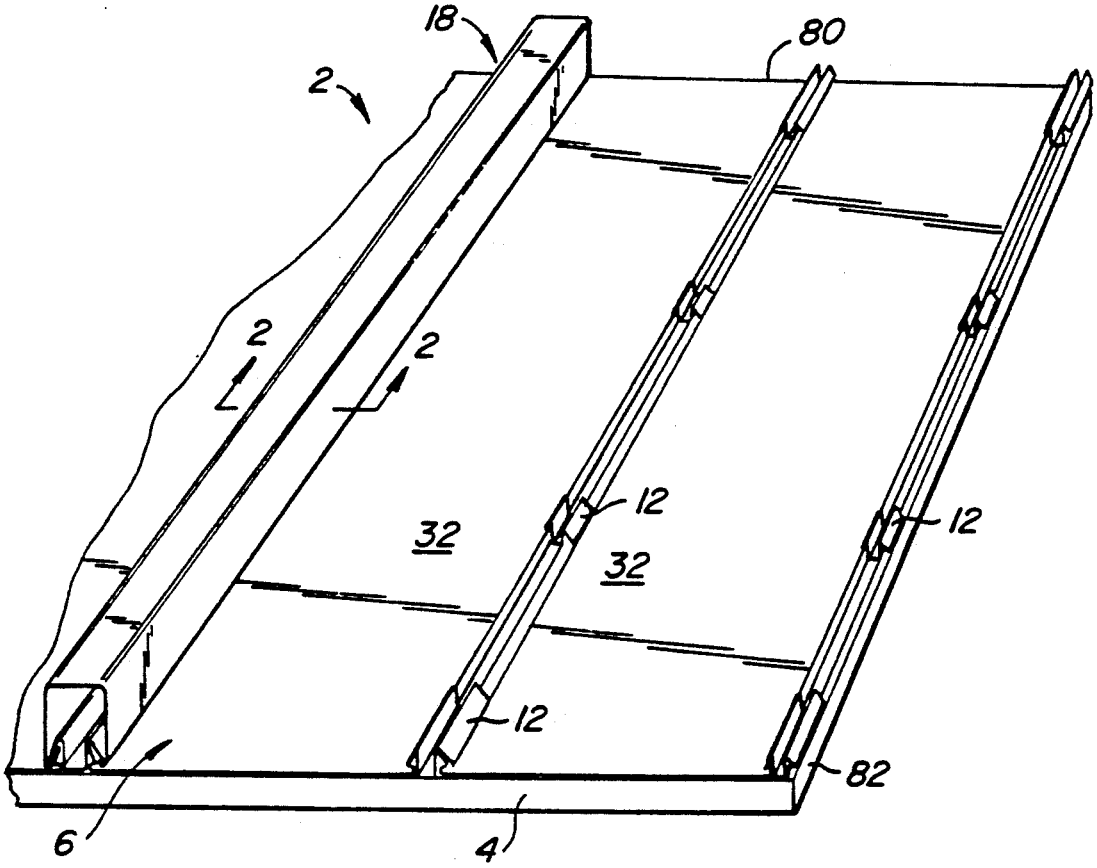
FIG. 1 shows a roofing/cladding system made according to the invention mounted to a section of a roof.
Figure 2:
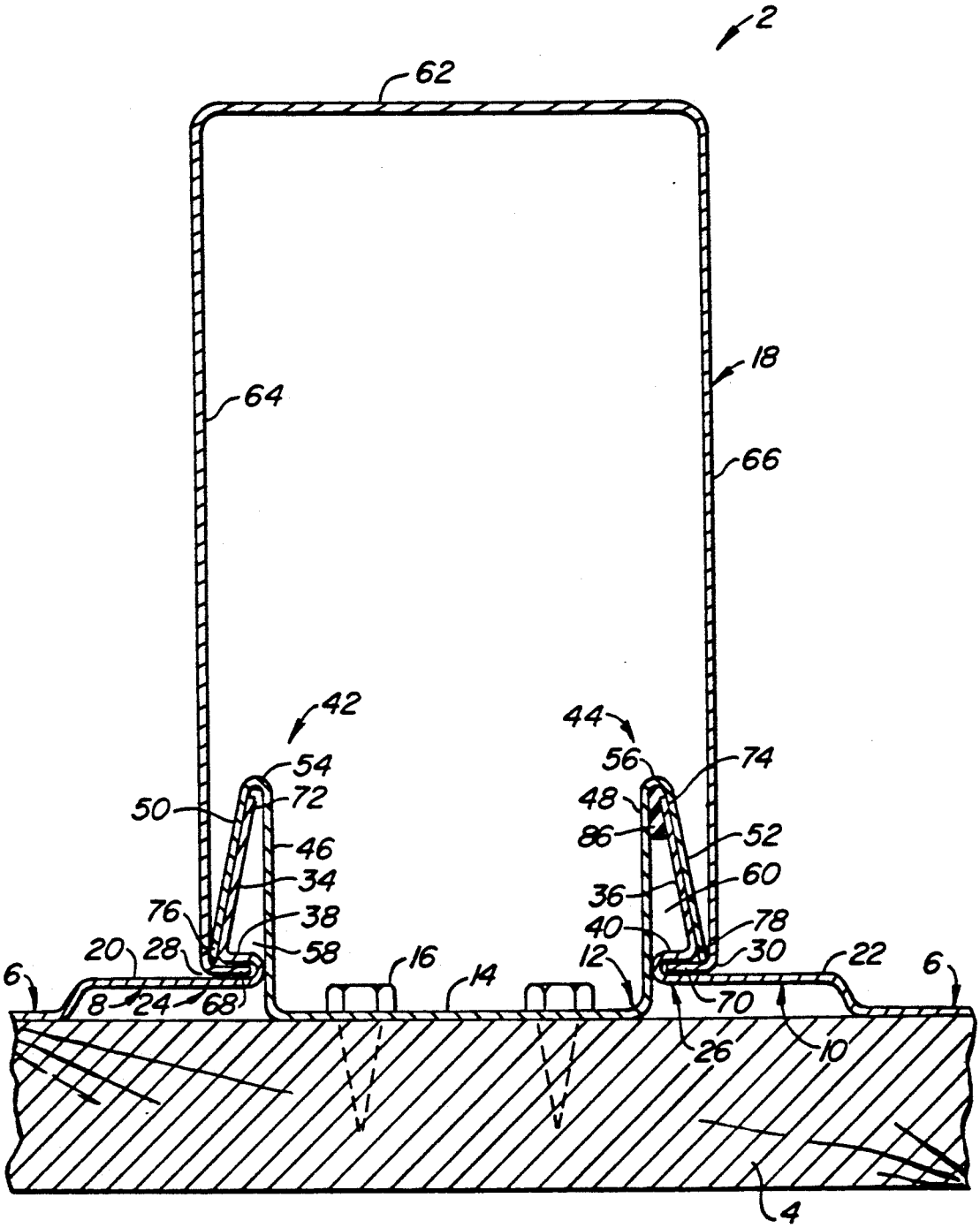
FIG. 2 is an enlarged cross-sectional view taken along line 2—2 of FIG. 1.

FIGS. 1 and 2 illustrate a roofing/cladding system 2 mounted to a support structure in the form of a roof 4. System 2 includes a number of pans 6 secured to roof 4 along first and second edges 8, 10 by brackets 12. Brackets 12 have a base 14 through which threaded fasteners 16 pass to secure bracket 12, and thus pans 6, to roof 4. A batten 18 is mounted over brackets 12 along the edges 8, 10 of adjacent pans 6 to weatherproof the joint.

Edges 8, 10 of pans 6 includes offset portions 20, 22 which terminate in a U-shaped pockets 24, 26. Pockets 24, 26 define edge recesses 28, 30 which open towards the central portions 32 of pans 6. Edges 8, 10 also include generally vertically extending legs 34, 36 extending from the upper parts 38, 40 of pockets 24, 26.

Brackets 12 include first and second hold-down elements 42, 44 having first, upwardly extending arms 46, 48 extending from base 14 and second, downwardly extending arms 50, 52 extending from junctures 54, 56 of the arms to define generally V-shaped regions 58, 60 within which legs 34, 36 are housed. Batten 18 includes a top 62 and sides 64, 66 terminating in inwardly extending lips 68, 70 housed within edge recesses 28, 30.

As is evident from FIG. 2, the upper edges 72, 74 of legs 34, 36 are sheared off or plain, as opposed to being rolled over or pocketed, to reduce the resistance of those portions of pans 6 to being formed with a curve along their lengths. Also, vertical movement of pans 6 and batten 18, that is away from roof 4, is immediately inhibited by the engagement of lips 68, 70 with the lower ends 76, 78 of arms 50, 52. Further, upper edges 72, 74, being close to junctions 54, 56, also act to quickly inhibit vertical movement of pans 6 by bracket 12.

The lengths of legs 34, 36 is preferably less than about one-half the height of batten 18. By restricting the vertical height of the legs 34, 36, the resistance to forming pans 6 to cover a curved surface, in either a convex or a concave manner, is reduced.

As shown in FIG. 1, certain of the brackets 12 are shorter than other of the brackets 12. This permits a greater hold-down force to be provided in regions of the supporting structure at which the vertical lifting loads are the greatest, such as near the ridge 80 of roof 4. Also, a continuous or substantially continuous bracket 12 can be used, such as along the edge 82 of roof 4.

Figure 3:
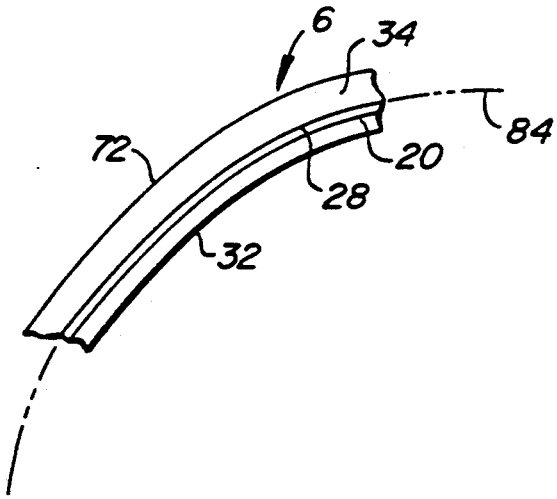
FIG. 3 is an edge view of a pan of FIG. 1 with a convex curvature.

FIG. 3 shows a pan 6 having a convex curvature with a neutral axis 84 positioned very close to offset portion 20 of pan 6. That is, the portion of pan 6 inward of neutral axis 84 is in compression while the portion of pan 6 outside of axis 84 is in tension. Since the distance between axis 84 and central portion 32 is quite small, the amount of deformation of those portions of pan 6 which are visible once batten 18 is in place is very small. That is, the only substantial deformation which could take place would be along upper edge 72 of leg 34, which is protected from both view and the elements by bracket 12 and batten 18. A similar result occurs when pan 6 is bent to a concave curve.

Pans 6 and battens 18 are preferably formed on site using roll forming machines. This enables entire lengths of pans 6 and batten 18 to made without the need for lap joints. Pans 6 are positioned on roof 4. One or more brackets 12 are positioned over the upstanding legs 34 of adjacent pans 6 and secured to roof 4 using fastener 16. After so secured, batten 18 is mounted over the joint, typically by inserting lip 68 into edge recess 28 and then rotating batten 18 to its position of FIG. 2 to allow lip 70 to snap into edge recess 30. As shown in FIG. 2, an appropriate sealant 86 may be used to help prevent migration of moisture onto roof 4, typically by capillary action. Sealant 86 could be used at other positions, such as within edge recesses 28, 30, as well.

Modification and variation can be made to the disclosed embodiment without departing from the subject of the invention as defined in the following claims. For example, longitudinally arranged corrugations can be formed in central portion of pan 6, preferably no higher than offset portion 20, for strength. Different types of fastening systems can be used to fasten bracket 12 to roof 4 if desired.

What is claimed is:

1. A roofing/cladding system for mounting to a structure comprising:

first and second pans having central portions and first and second edges, the first edge of the first pan being positionable parallel to and closely spaced apart from the second edge of the second pan;

the first and second edges of each said pan having first and second U-shaped pockets defining U-shaped edge recesses opening toward the central portion of each said pan, the U-shaped pockets having generally parallel sides and upper parts;

the first and second edges of each said pan having legs extending from the upper parts of the U-shaped pockets, the legs extending outwardly, that is away from the structure;

a bracket having a base, mountable to the structure between the opposed first and second edges, and first and second hold-down elements engageable with the opposed first and second edges, the hold-down elements each having and outwardly extending first arm and an inwardly extending, that is toward the structure, second arm defining a region within which one of the legs is positionable, the second arm having a lower end generally aligned with the upper part of the U-shaped pocket adjacent said one leg;

the first and second arms of each said hold-down element being joined at a junction, the legs having outward edges positionable adjacent the junction so that any outward movement of the pans relative to the bracket is immediately resisted by the engagement of the outward edges with said junctions; and a batten having sides with edges and lips extending towards one another from the edges, the lips sized and positioned to engage the U-shaped edge recesses directly inwardly of the lower ends of the second arms so that outwardly directed lifting forces on the pans and batten are immediately resisted by the engagement of the lips of the batten with the bracket.

2. The system of claim 1 wherein the outwardly extending legs have plain upper edges to facilitate forming the pans with a chosen curvature.

3. The system of claim 1 further comprising threaded fastener elements passing through the base of the bracket for securing the bracket to the structure.

4. The system of claim 1 wherein the bracket has a variable length chosen according to the amount of hold-down force is required at the part of the structure said bracket is used.

5. A roofing/cladding system for mounting to a structure comprising:

first and second pans having central portions and first and second edges, the first edge of the first pan being positionable parallel to and closely spaced part from the second edge of the second pan;

the first and second edges of each said pan having first and second U-shaped pockets defining edge recesses opening towards the central portions of the panel, the U-shaped pockets having generally parallel sides and upper parts;

the first and second edges of each said pan having legs extending from the upper parts of the pockets, the legs extending outwardly, that is away from the structure, the outwardly extending legs having plain upper edges to facilitate forming the pans with a chosen curvature;

a bracket having a base, mountable to the structure between the opposed first and second edges, and first and second hold-down elements engageable with the opposed first and second edges, the hold-down elements each having an outwardly extending first arm and an inwardly extending, that is toward the structure, second arm defining a region within which one of the legs is positionable, the second arm having a lower end generally aligned with the upper part of the pocket adjacent said one leg; and the first and second arms of each said hold-down element being joined at a junction, the upper edges of the legs being positionable adjacent the junction so that any outward movement of the pans relative to the bracket is generally immediately restricted by the engagement of the outward edges with said junctions; and a batten having sides with edges and lips extending towards one another from the edges, the lips sized and positioned to engage the edge recesses directly inwardly of the lower ends of the second arms;

whereby outwardly directed lifting forces on the pan and batten are immediately resisted by the engagement of the lip of the batten with the bracket.

* * * * *